United States Patent [19]

Barrett et al.

[11] Patent Number: 4,632,046

[45] Date of Patent: Dec. 30, 1986

[54] ASSEMBLY SYSTEM FOR SEAMED ARTICLES

[75] Inventors: David S. Barrett, Lowell; Arthur Ciccolo, Melrose; Donald C. Fyler, Cambridge, all of Mass.; F. Keith Glick, Colorado Springs, Colo.; John R. Lawson, Lincoln, Mass.; Jay A. Sampson, Belmont, Mass.; Frank J. Siraco, Malden, Mass.; Robert D. Whiteside, Watertown, Mass.; Daniel E. Whitney, Arlington, Mass.; George A. Wood, Lincoln, Mass.

[73] Assignee: The Charles Stark Draper Laboratory, Inc., Cambridge, Mass.

[21] Appl. No.: 707,608

[22] Filed: Mar. 4, 1985

[51] Int. Cl.[4] ..... D05B 3/04

[52] U.S. Cl. ..... 112/121.14; 112/304

[58] Field of Search ..... 112/121.14, 121.11, 112/121.12, 121.15, 304, 2

[56] References Cited

U.S. PATENT DOCUMENTS

| | | | |
|---|---|---|---|
| 2,546,831 | 5/1951 | 05001951 | Newell/ |
| 3,800,719 | 4/1974 | Rockerath . | |
| 3,862,610 | 1/1975 | Brocklehurst | 112/121.14 X |
| 4,432,295 | 2/1984 | Raisin et al. . | |
| 4,457,243 | 7/1984 | Bowditch | 112/121.14 |
| 4,512,269 | 4/1985 | Bowditch | 112/304 X |

FOREIGN PATENT DOCUMENTS

| | | |
|---|---|---|
| 0056760 | 1/1982 | European Pat. Off. . |
| 2206510 | 8/1973 | Fed. Rep. of Germany . |
| 2453195 | 5/1976 | Fed. Rep. of Germany . |
| 1555363 | 12/1968 | France . |
| 472328 | 6/1969 | Switzerland . |
| 1191456 | 5/1970 | United Kingdom . |

*Primary Examiner*—H. Hampton Hunter

*Attorney, Agent, or Firm*—Lahive & Cockfield

[57] ABSTRACT

A limp material handling system includes a manipulating apparatus for selectively manipulating one or more layers of limp material on a support table. Folding is accomplished by lifting a curvilinear region of the material, reshaping that lifted region as desired, and lowering that lifted region to a curvilinear region on the support table. A seamed article assembly system incorporates the manipulating apparatus, a seam joining apparatus and a multiple parallel endless belt system for tactile presentation of the limp material to the seam joining apparatus. An optical sensing system provides information representative of the position of the limp material being handled. A programmable computer, or controller, coordinates and controls the operation of the manipulating apparatus, seam joining apparatus, belt assembly, and optical sensing system to provide automatic assembly of seamed articles.

21 Claims, 14 Drawing Figures

ASSEMBLY SYSTEM FOR SEAMED ARTICLES

REFERENCE TO RELATED APPLICATIONS

The subject matter of this application is related to that of U.S. Pat. No. 4,401,044, entitled "System and Method for Manufacturing Seamed Articles", and U.S. patent application Ser. No. 345,756, entitled "Automated Seamed Joining Apparatus", filed Feb. 4, 1983, and U.S. patent application Ser. No. 515,126, entitled "Automated Assembly System For Seamed Articles", filed July 19, 1983.

BACKGROUND OF THE INVENTION

This invention relates to the assembly of seamed articles made from limp material, such as fabric. In particular, the invention relates to systems for automated, or computer-controlled, assembly of seamed articles from limp material.

Conventional assembly line manufacture of seamed articles constructed of limp fabric consists of a series of manually controlled assembly operations. Generally tactile presentation and control of the fabric-to-be-joined is made to the joining, or sewing, head under manual control. One drawback of this application technique is that the technique is labor intensive; that is, a large portion of the cost for manufacture is spent on labor. To reduce cost, automated or computer-controlled manufacturing techniques have been proposed in the prior art.

An automated approach to fabric presentation and control is disclosed in U.S. patent application Ser. No. 345,756. As there disclosed, pairs of belt assemblies are positioned on either side of a planar fabric locus. The respective belt assemblies are driven to selectively provide relative motion along a reference axis to layers of fabric lying in the fabric locus. A joining, or sewing, head is adapted for motion adjacent to the fabric locus along an axis perpendicular to the reference axis. The respective belts maintain control of the limp fabric in the region traversed by the sewing head, with the respective belts being selectively retracted, permitting passage therebetween of the sewing head as it advances along its axis of motion. With this approach, control of the limp fabric is permitted in the regions which are to be joined.

Systems for the manufacture of seamed articles from a strip of limp fabric disclosed in U.S. patent application Ser. No. 515,126 provide more precise "near field" control of limp fabric, that is fabric control in regions close to the sewing head. Those systems include a feeder for selectively feeding these strips of limp fabric in the direction of a first (Y) reference axis. Control of presentation may also be maintained in a second (X) axis perpendicular to and intersecting the Y axis.

In some forms, a folding apparatus controls the position of the fabric so that the strip of fabric is folded onto itself along a fold axis offset from the axis of feed (Y axis) so that there is a folded portion having an upper layer overlying a lower layer. A support is used to position the upper and lower layers of the folded portion in a substantially planar fabric locus.

In one form of those systems, the support includes a frame member, a support assembly coupled to the feeder, and a drive motor and an associated linkage for selectively positioning the frame member with respect to the support assembly in the direction of the X axis. A pair of lower belt assemblies is coupled to the frame member, where each lower belt assembly includes a plurality of continuous loop lower belts underlying the fabric locus. The lower belts are adapted on their outer, uppermost surface for frictional coupling with the lower layer of the folded portion. The lower belt assemblies are adjacently positioned along the X axis, with each assembly including an associated driver for selectively driving the lower belts so that the lower fabric layer coupled to those belts is positionable in the direction of the X axis.

A pair of upper belt assemblies is coupled to the frame member as well. The upper belt assemblies are adapted to be positioned to overlie the lower belt assemblies. Each of the upper belt assemblies includes a plurality of upper belts (which may be positioned opposite the respective lower belts). The upper belts have planar lowermost portions spaced apart from the uppermost of the lower belts. The upper belts are adapted on their outer, lowermost surface for frictional coupling with the upper layer of the folded portion. Each of the upper belt assemblies has an associated driver for selectively driving those upper belts so that the lower layer coupled to those belts is positionable in the direction of the X axis. The region between the lowermost portions of the upper belts and the uppermost portions of the lower belts defines the fabric locus, so that the fabric locus is substantially parallel to the plane formed by the intersecting X and Y axes.

In general, a computer-controller is used to selectively control the drivers for the respective belts so that the upper and lower layers may be substantially independently positioned in the direction of the X axis along the fabric locus. In alternative forms of those systems, the respective belt assemblies may be controllable in the Y axis direction as well, so that the upper and lower layers may be substantially independently positioned in the direction of both the X and Y axes along the fabric locus, thereby permitting control motion of the respective layers in those directions.

A fabric joiner, or sewing head, includes an upper assembly and a lower assembly. These upper and lower assemblies are adapted for tandem motion along the direction parallel to the Y axis between the upper belt assemblies and the lower belt assemblies. An associated driver provides control of the position of the upper and lower assemblies of the joiner along its axis of motion. The joiner is selectively operable to form seams in fabric in the fabric locus under the control of a computer-controller.

In one form of the systems of those systems, at least one pair of the pairs of the adjacent belt assemblies includes opposing pairs of closed loop belts and an associated controller adapted so that the pairs of the closed loop belts are selectively retractable in the X direction to permit passage of the joining head therebetween in the Y direction, for example, in the manner disclosed in U.S. patent application Ser. No. 345,756.

The joining head may include a needle assembly having a thread-carrying, elongated needle extending along a needle reference axis perpendicular to the fabric locus. In operation, the needle is driven through the fabric locus in a reciprocal motion along the needle reference axis. The needle assembly further includes an upper feed dog assembly which is responsive to an applied upper dog drive signal for selectively driving the uppermost layer of fabric in the region adjacent to the needle in the direction of an upper axis which is perpendicular to the needle reference axis.

A bobbin assembly is generally used in those systems and is adapted for interaction with the needle assembly to form the stitches of the seam. The bobbin assembly includes a lower feed dog assembly which is responsive to a lower dog drive signal for selectively driving the lowermost layer of fabric in the region adjacent to the needle in the direction of a lower axis which is perpendicular to the needle reference axis.

In one form of those systems, a controller generates a part assembly signal representative of the desired position of the junction of the layers of fabric relative to those layers. Registration sensors provide signals representative of the current position of the respective uppermost and lowermost fabric layers. A controller provides overall control for the belt assemblies as well as the feed dogs and needle and bobbin assembly rotational and feed dog control, in order to achieve coordinated motions of the respective assemblies. With this configuration, the respective belt assemblies provide far field, or global, position control for the upper and lower fabric layers. The feed dogs provide near field, or local, position control for the upper and lower layers of fabric in the regions near the needle of the joining head.

While the above-referenced systems do effectively provide approaches for the automated assembly of seamed articles, there are limitations in those operations particularly regarding the positioning, orienting and folding of limp fabric in preparation for joining of seams. Further, automated assembly systems require a feedback control system in order to accomplish these preparatory operations. In all such operations, it is important that accurate and repeated edge positioning of fabric be achieved in order to assure uniform quality of garment assembly. Moreover, these aspects are particularly important in view of desired high volume, and in view of the prior art requirement of specialized assemblies, requiring pattern- and size- dependent clamps or fixtures. Another factor for such automated assembly systems is that such systems must be cost effective compared with the existing approaches.

Accordingly, it is an object of the present invention to provide an improved system for automatic assembly of seamed articles.

Another object is to provide an improved automated assembly system for seamed articles including a relatively low cost optical feedback system controlling fabric location and orientation.

Yet another object is to provide an improved folding apparatus for folding fabric in automated seamed article assembly systems.

SUMMARY OF THE INVENTION

Briefly, the present invention is directed to a limp material handling system including a manipulating system for selectively manipulating one or more layers of limp material. The manipulating system includes a support assembly adapted to support the material on a reference surface. The manipulating system further includes a selectively operable fold assembly which includes a gripping apparatus for mechanically coupling to (or grapping or gripping) a curvilinear region of at least an uppermost layer of material on the support surface, and an apparatus for contour controlling and positioning for that gripped region of material, and for releasing that gripped region. In forms of the inventon adapted for folding limp material, the fold assembly further includes apparatus for selectively lifting and lowering a gripped region of material, so that a lifted region may be lowered down to the reference surface or the next uppermost layer of material overlying that reference surface. The gripping and releasing apparatus, the contour controlling and positioning apparatus and the lifting and lowering apparatus are all selectively operable under control of a control apparatus, which is generally controlled by a microcomputer in the preferred forms of the invention.

Generally, the fold assembly is operative to grip a curvilinear region of the material, then to control the curvature of that gripped curvilinear region so that the region has a selected contour, and to selectively translate and rotate that gripped region to a selected location overlying an associated curvilinear region of the reference surface, and then the material is released. To fold the material, a lifting operation for the gripped region is interspersed with these operations. Then, that translated and/or rotated and/or reconfigured curvilinear region is lowered to the underlying associated curvilinear region of the reference surface, or onto material overlying that associated curvilinear region on the reference surface.

Particularly, in article assembly systems in accordance with the invention, the system further includes a seam joining apparatus, such as a sewing machine, which is selectively positioned along a reference axis. The seam joining apparatus is adapted to selectively join adjacent regions of one or more layers of the limp material elements passing through that reference axis. The assembly system further includes a multiple parallel endless belt assembly, which is adapted to selectively transport and align the limp material in order to present that material to the seam joining apparatus at points on the first reference axis.

This belt assembly also provides selective orientation of the limp material elements to be joined. The respective belts of the belt assembly are selectively controllable to provide a desired tension in the limp material elements in regions of the limp material adjacent to and including the first reference axis, so that seam joining occur under controlled tension. Furthermore, the belts may be selectively driven in order to reposition upper and lower layers of a multilayer material at the sewing head in order to accomplish relative positioning of those layers, and further to provide capability to achieve easing and the generation of three dimensional seams.

All of these operations are provided under the control of an assembly controller which establishes the selected positioning, folding and joining of the limp material to assemble seamed articles.

In some forms of the invention, an optical sensing system provides optical feedback to the controller in order to sense the current position and various characteristics of the material which is being assembled into articles. The optical sensing system provides information representative of the edges of such materials as well, so that the folding apparatus may operate to accomplish the desired manipulations and/or folds by controlling the positioning of the edges of the material in such a manner to achieve the desired manipulation and/or folding.

In one form of the invention, a particularly cost effective optical sensing system is provided by incorporating a television camera for generating video signals using a common axis illumination system. This configuration provides video signals representative of an image along the camera's optical axis of the reference surface and any limp material on that surface within the field of view of the camera. The reference surface provides a relatively high contrast optical reflectivity with respect to material positioned on that surface.

With this configuration, the article assembly system may construct seamed articles, such as garments, in a manner providing accurate and repeatable edge positioning, thereby leading to highly uniform quality of garment assembly. Particularly, the folding apparatus is well adapted to attaching to the limp material, picking that edge up, reshaping that edge as desired, and moving it and placing it down elsewhere on the surface with substantially high accuracy. The reshaping of the edge permits matching to another edge of material already on the surface, so that the overlying edges may be then joined to form a desired seam, thereby permitting joining of dissimilarly-shaped edges.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
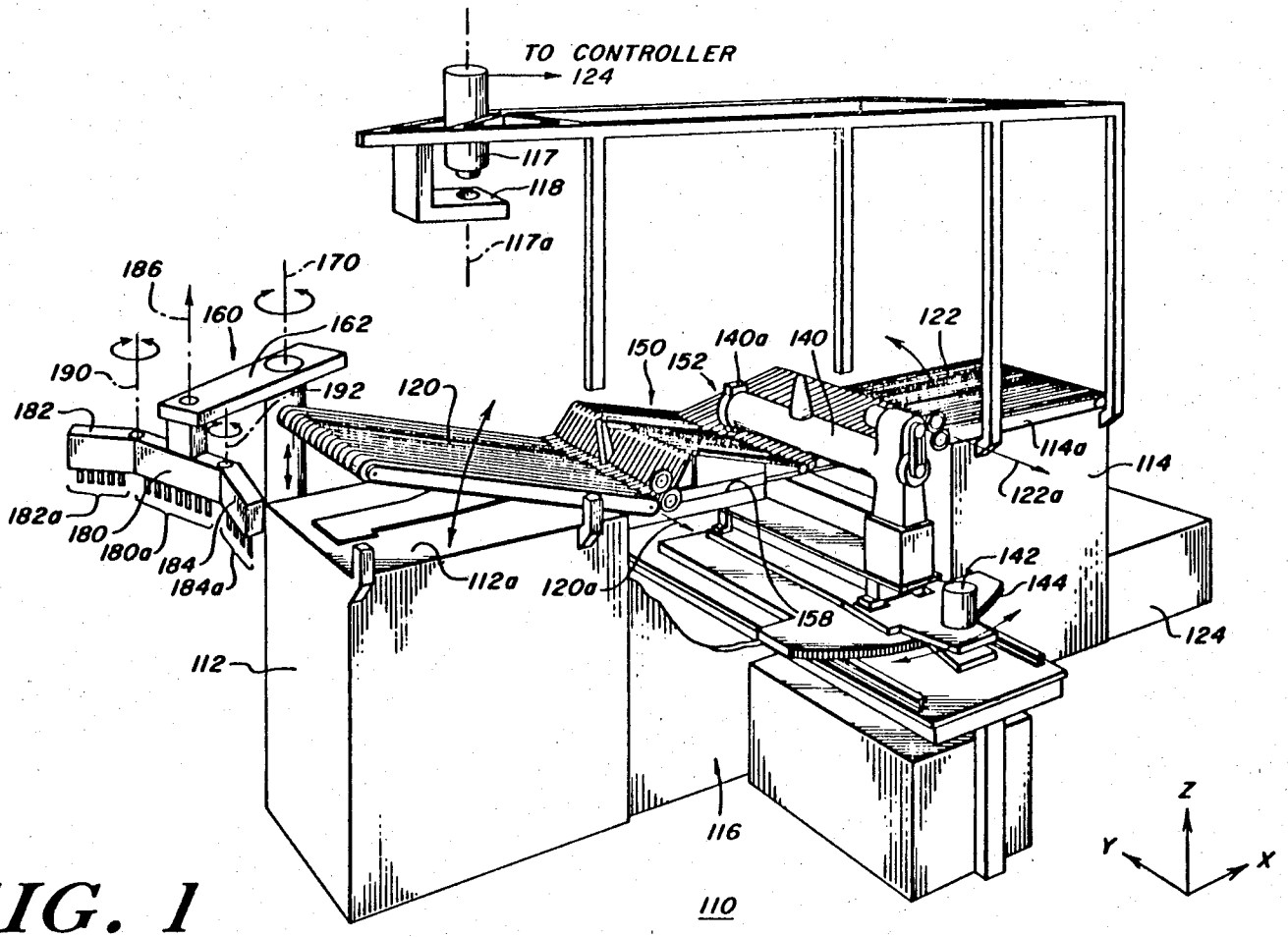
FIG. 1 shows an isometric representation of the principal elements of an exemplary embodiment of the present invention.

FIG. 1 shows an isometric representation of principal elements of a preferred form of an assembly system 110 together with a set of intersecting reference coordinate axes X, Y and Z. The system 110 includes two support tables 112 and 114 and a seam joining assembly 116. The system 110 further includes an optical sensor system overlying table 112 and including a television camera 117 and a common-axis illumination system 118. In alternative embodiments, an additional optical sensor system may similarly overlie table 114, for use in loading or unloading and orienting limp material elements, for example.

Each of the support tables 112 and 114 includes a respective one of planar upper surfaces **112*a* and 114*a*. In alternative embodiments, other or both of the surfaces 112*a* and 114*a*** may differ from planar. For example, those surfaces may be cylindrical about an axis parallel to the Y axis.

A set of parallel endless belts (120 and 122) is affixed to each of tables 112 and 114. Each set of belts 120 and 122 is pivotable about a respective one of axes **120*a* and 122*a* each of which is parallel to the Y axis from a position substantially parallel to one of surfaces 112*a* and 114*a* (closed) to a position substantially perpendicular to one of those surfaces (open). In FIG. 1, belt set 120 is shown in a partially open position, and belt set 122 is shown in a closed position substantially parallel to the top surface 114*a* of table 114**.

Figure 2:
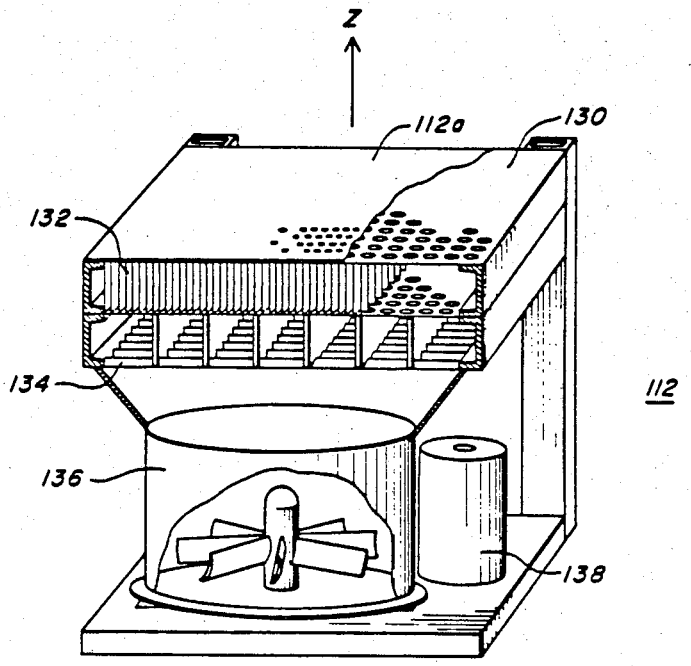
FIG. 2 shows a partially cutaway view of a support table for the system of FIG. 1.

FIG. 2 shows a partially cutaway view of the support table 112. That support table 112 as shown includes a perforated retro-reflective surface which forms the surface **112*a*. In the present embodiment, the surface 112*a* is formed by retro-reflective material type for example as manufactured by 3M Corporation, where that retro-reflective material forming the surface 112*a* includes a rectangular array of holes, each hole having a diameter equal to 1/32 inches, with the array having a center-to-center spacing of 1/16 inches. In alternate embodiments, the array may be other than rectangular, for example, hexagonal or spiral or circular with holes having a sufficient diameter and the adjacent holes of the array having center-to-center spacing appropriate to permit sufficient air mass flow therethrough to provide a suitable vacuum for holding limp material down to the surface. By the way of example, the array of holes in surface 112*a*** may be established using a commercial laser.

In the presently described embodiments, the upper surface **112*a* overlies an aluminum plate having an array of holes which substantially matches the array of holes in the surface 112*a*. That aluminum plate 130 overlies a composite beam honeycomb table top 132 which includes an array of honeycomb tubular structures extending in the direction of the Z axis. That honeycomb table top 132 is supported over a multiple plenum valve module which provides selectively operable rows of valves. In FIG. 2, there are eight rows of valves shown, with six of those rows in the open position and two of those rows in the closed position. The valve module 134 is coupled to a vacuum blower 136 which in turn is driven by a motor 138. With this configuration, a vacuum is selectively provided to various regions at surface 112*a*. The vacuum is particularly useful in holding various layers of material in a desired position on surface 112*a*. The positionin may be accomplished by a material folding or by a material manipulator, for example. The surface 112*a* also has retro-reflective optical properties so that with top lighting, reflective light is directed in the Z direction to provide a high contrast background against any cloth object placed on surface 112*a*. The latter feature is particularly useful in systems having optical sensors which can identify the location and orientation of material on surface 112*a***.

The sewing assembly 116 includes a sewing machine 140 adapted for linear motion along the Y axis. The sewing machine is also pivotable about its needle axis as driven by control 124 by way of motor 142 and gear assembly 144. The sewing assembly 116 further includes an interlocking belt assembly including a first set of parallel endless belts 150 and a second set of parallel endless belts 152. The belts of sets 150 and 152 are adapted so that their lower surface may frictionally drive material between those lower surfaces and an underlying support surface 160 which is generally in continuous with surfaces **112*a* and 114*a*, under the control of the controller 124**.

Figure 3:
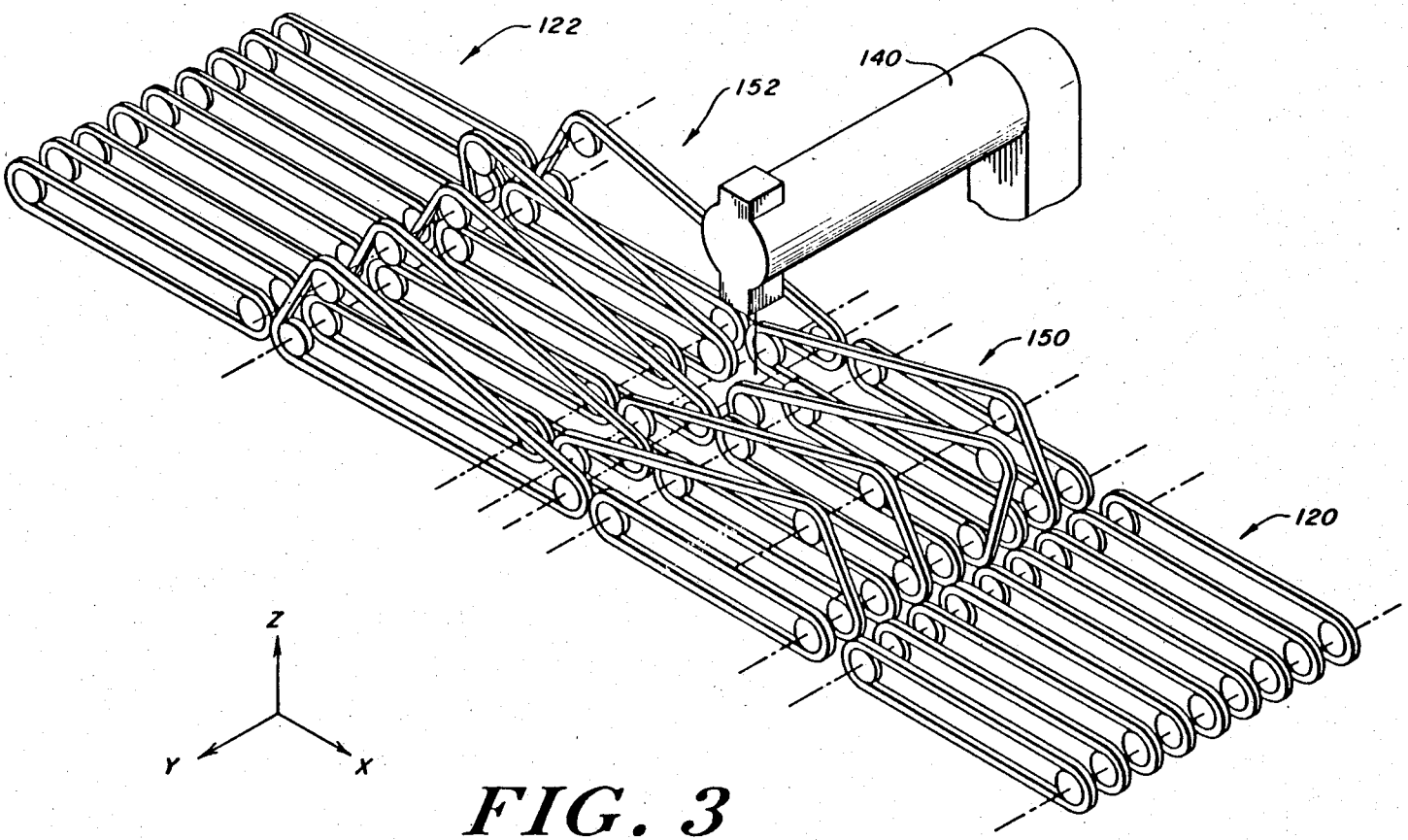
FIG. 3 shows schematically the upper endless belts of the system of FIG. 1.

FIG. 3 shows the belt assemblies 120 150, 152, and 122, in schematic form, together with the sewing machine 140, wherein the belt sets 150 and 152 include alternating sets of three roller endless belts and two point continuous belts. In operation, the controller 124 controls the belts adjacent to the sewing head of sewing machine 140 to be retracted from the locus of the needle while that needle is in the region between the belts. Otherwise, the belts of the opposed sets 150 and 152 are adjacent to each other. The belts may be driven by controller 124 in a manner providing controlled fabric tension for fabric between the lower surface of the belts of sets 150 and 152 and the upper surface 158. In various embodiments of the invention, the surface 158 may also include multiple endless belt assemblies underlying respective belts of sets 150 and 152. The latter belt sets are also controlled by the controller 124 in order to achieve substantially independent control of upper and lower layers of fabric positioned between the sets of belts 150 and 152 and those sets underlying sets 150 and 152.

Figure 4A:
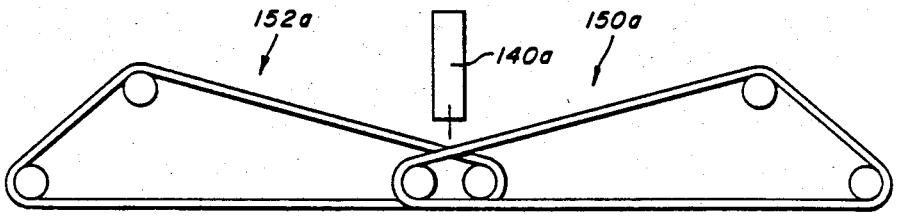
FIGS. 4A and 4B illustrate the operation of the retractable belts of the system of FIG. 1.
Figure 4B:
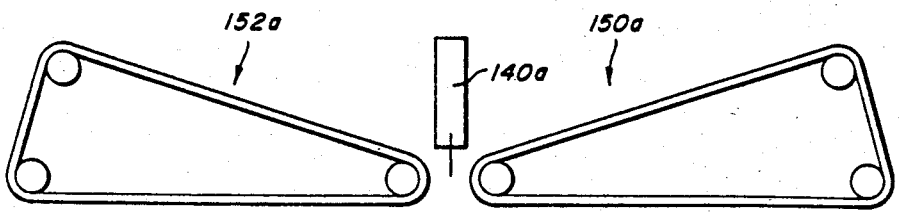

By way of example, the belts may be 0.03 to 0.04 inches thick, ⅜ inch wide neoprene toothed timing belts with polyester fiber reinforcement supported by toothed roller assemblies. A layer of polyurethane foam is attached to the outer belt surfaces with adhesive. With this configuration, the foam provide substantial frictional contact with material adjacent to the belts so that as the belt moves, it positions the fabric adjacent thereto in the corresponding manner. For t:e upper belts the layer is ⅜ inches thick and for the lower belts the layer is ¼ inches thick. The thicker layer provides increased adapability for materials characterized by varying thicknesses, FIG. 4A shows two interlocking belts 150*a* and 152*a* of the sets 150 and 152, in a first state, where the sewing machine head 140*a* is positioned other than between these two belts. FIG. 4B shows those same interlocking belts in a second state when the sewing head 140*a* is positioned between those two belts 150*a* and 152*a.* As shown in FIGS. 4*a* and 4*b,* each of belts 150*a* and 152*a* is positioned about three rollers, one of which is fixed (the rightmost roller shown in FIGS. 4*a* and 4*b* for belt 150*a,* and the leftmost roller shown in FIGS. 4*a* and 4*b* for belt 152*a*) and the other two of which for each of belts 150*a* and 152*a* are controllably positioned. With the present embodiment, as limp fabric to be sewn is adjustably positioned between the belts of sets of 150 and 152 and the surface 160, the sewing machine 140 may be selectively controlled to traverse the gaps established by the retracting belts along axis parallel to the Y axis of machine 140 so that selective stitching may be accomplished on that fabric, under the control of controller 124.

The system 110 further includes a material manipulation system for fabric on the support table 112. That manipulation system includes the controller 124, and a folding assembly 160. The folding assembly 160 includes a controllable arm portion 162 which is selectively movable in the Z direction and selectively rotatable about the axis 170. The folding assembly 160 includes a hinged, linearly segmented assembly 174. That assembly includes three elongated segments 180, 182, and 184. Each of the segments 182 and 184 is selectively rotatable with respect to segment 180 about one of axes 190 and 192, so that the orientation of those segments 182 and 184 are selectively controlled with respect to the angular orientation of segment 180, all under the control of controller 124. The segment 180 is rotatable about the axis 186 under the control of controller 124. Each of segments 180, 182 and 184 includes a plurality of gripping elements distributed along the principle axis of that segment.

The gripping elements are denoted in FIG. 1 by reference designation 180*a,* 182*a* and 184*a.* Each of the gripping elements is adapted for selectively gripping regions of any fabric underlying those elements. The arm portion 162 is selectively controllable in the Z direction. As a result, when the gripping elements are affixed to a portion of the material, that portion may be selectively lifted and then lowered (in the Z direction) with respect to the surface 112*a.* In the present embodiment, the elements 180*a,* 182*a* and 184*a* are also each selectively movable in a direction parallel to the X-Y plane in the direction perpendicular to the principle axes of the respective ones of segments 180, 182 and 184. The gripping elements 180*a,* 182*a* and 184*a* are also selectively rotatable about an axis 186.

With this configuration, the folding assembly 160 may be used as a material manipulator for material on surface 112*a,* whereby selective curvilinear portions of that material may be sequentially grabbed by the gripping elements, and then translated and/or rotated and/or reshaped, and then released. The folding assembly 160 may also be used as a material folder by selectively performing the operations described for the manipulator, interspersed with lifting and lowering operations, particularly as described in configuration FIGS. 6A–6F.

In one form of the invention, each of the gripping elements may comprise a substantially tubular member coupling a vacuum thereto, which may be selectively applied. Alternatively, each of the gripping elements may include a grabber which comprises an elongated member extending along an axis perpendicular to the Z axis having a barb extending from the tip closest to the surface 112*a.* In the latter embodiment, the elongated member, or barbed needles, may be selectively reciprocated in the Z direction under the control of controller 124.

Figure 5:
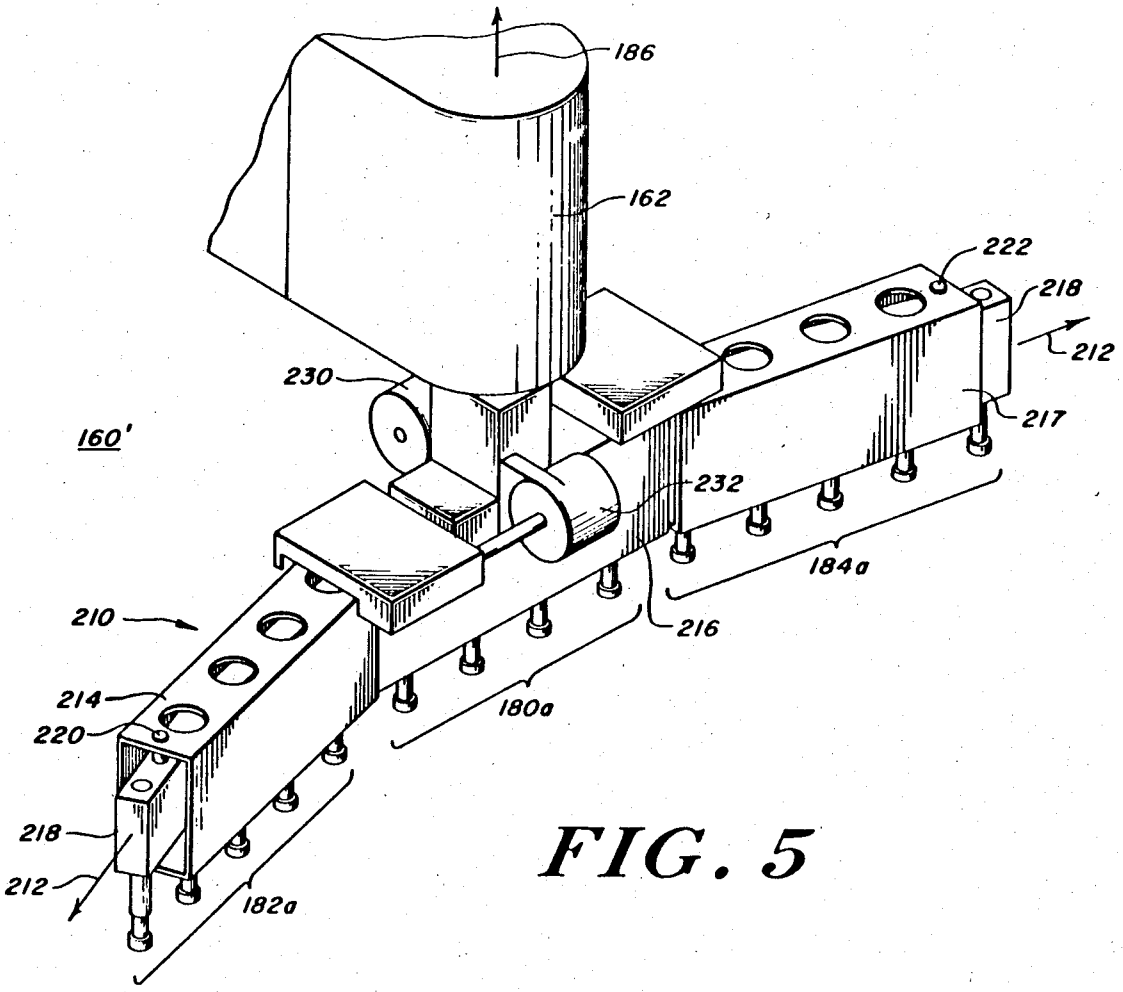
FIG. 5 shows an isometric representation of an exemplary fabric folding system for use with the system of FIG. 1.

FIG. 5 shows an alternative embodiment 160' for the assembly 160 of FIG. 1. In that FIG. 5, corresponding elements are identified with identical reference designations. In FIG. 5, assembly 160 includes an elongated carrier assembly 210 having a curvilinear central axis 212 extending along its length. Axis 212 is substantially parallel to surface 112*a.* In other embodiments, for example, where surface 112*a* is not planar, the axis 212 may not be parallel to surface 112*a.* In the present embodiment, the carrier assembly 210 includes a hinged housing (including sections 214, 216 and 217) and a flexible member 218 which is coaxial with axis 212. One end of flexible member 218 is fixed to housing segment 214 at point 220 and the other end is slidably coupled to housing segment 218 at point 222. Forcers 230 and 232 are adapted to applying transverse forces to member 218 at points between the end points to control the curvature of axis 212. As the forcers 230 and 232 control the orientation of the axis 212, each of the gripping elements may be selectively displaced to provide the desired orientation of the gripping elements. This embodiment in effect provides a cubic spline. In other embodiments, differing numbers of forcers may be used. In the assembly 160, flexible cubic (or higher order) splines may be used to position the gripping elements in any or all of segments 180, 182 and 184.

With either configuration 160 or 160', the gripping elements may be selectively driven to form a desired curvilinear contour over a portion of material on the table 112a. The gripping elements 180a, 182a and 184a may be selectively lowered to the material on the table 112a so that those gripping elements may be activated to couple to (or "grab") the material at a corresponding curvilinear region of at least an uppermost layer of the fabric on the surface 112a. To partially accomplish folding, the assembly 160 (or 160') may then be raised in the Z direction in a manner lifting that uppermost layer of the material.

The gripping elements may then be translated and/or rotated, and repositioned (to modify the curvature of axis 212) so that the grabbed region of the uppermost layer of material is repositioned to a selective location overlying a predetermined location over the surface 112a. The assembly 160 (or 160') may then be lowered so that the lifted material is adjacent to the surface 112a or overlying the material on surface on 112a. All of this operation is under the control of controller 124. The vacuum at surface 112a holds the material in position when that material is adapted to surface 112a.

Figure 6A:
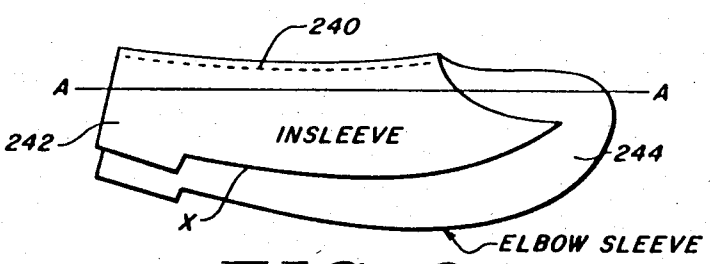
FIGS. 6A–6F illustrate the folding and sewing operations performed during the automated assembly of a sleeve by the system of FIG. 1.
Figure 6B:
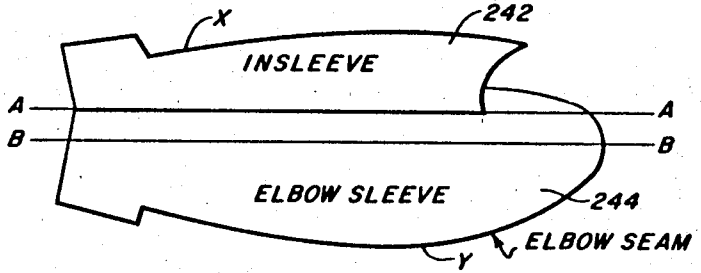
Figure 6C:
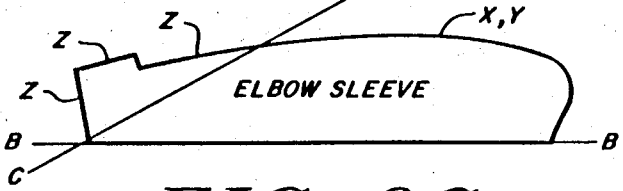
Figure 6D:
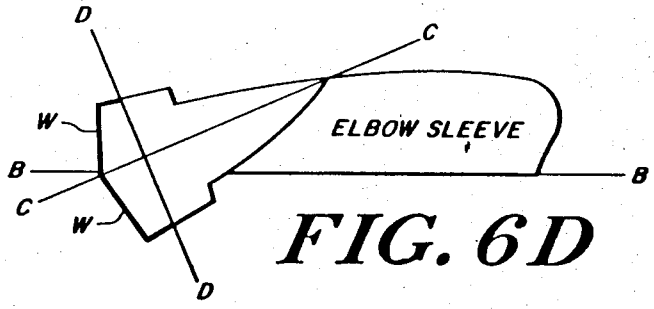
Figure 6E:
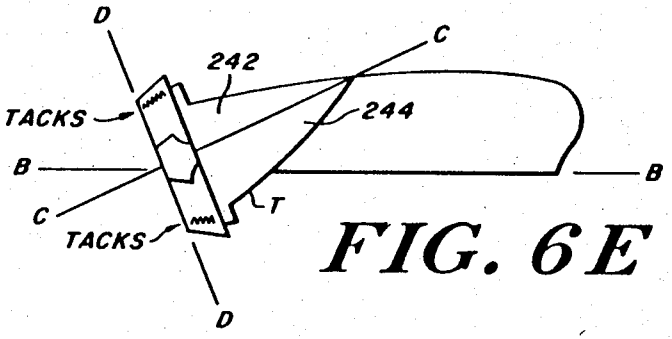

By selectively performing this operation over desired curvilinear regions of the material, a desired folding operation of the material may be attained. FIGS. 6A–6F show an exemplary folding sequence for assembling a sleeve. In that figure, a multilayer fabric assembly is first sewn (with easing) along the dotted line designated 240 in FIG. 6A. That assembly includes an in-sleeve portion 242 and an out-sleeve portion 244. Initially, the gripping elements 180a, 182a and 184a may be positioned along the heavy lined portion of in-sleeve 242 denoted X in FIG. 6A. That contour may be then picked up and translated, reshaped and lowered (and held with vacuum at the surface 112) so that the contour X is reshaped and positioned at the location shown in FIG. 6B. With this configuration, the in-sleeve portion 242 has been folded about the axis A—A. The elements 180a, 182a and 184a may then release the material and the gripping elements may be rearranged to match the contour denoted Y in FIG. 6B. That portion of the material may then be picked up by the gripping elements and the contour reshaped so that it is then repositioned and shaped as shown in FIG. 6C, with contour X overlapping contour Y. As a result, the material assembly is then folded along line B—B. Then, contour Y is released and the elements 180a, 182a and 184a are controlled to grip the contour Z on portion 244 shown in FIG. 6C. That contour is then lifted and folded about line C—C as shown in FIG. 6D. Then contour Z is released and the gripping elements are configured to grip contour W shown in FIG. 6D. That gripped contour is then folded about line D—D, as shown in FIG. 6E. The sleeve assembly is then presented to sewing head 140a.

Figure 6F:
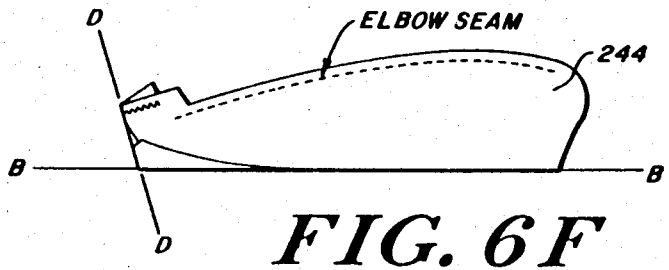

By performing a tacking operation, the sewing head 140a as shown in FIG. 6F, the sleeve may be partially assembled. The material may then be translated back out to the surface 112a, and the contour T of the out-sleeve 244 may be lifted by the assembly 160 (or 160') including elements 180a, 182a and 184a, and transferred and reconfigured to unfold about line C—C and match the contours X and Y as shown in FIG. 6F. The out-sleeve is then released from elements 180a, 182a and 184a, and the folded assembly is then transferred by way of belts 120 and 150 to the sewing head 140a, where the elbow seam 240 is then joined. Thus, with this configuration, the sleeve shown in FIG. 6F is assembled automatically under the control of controller 124. In all of these operations, the vacuum at surface 112a serves to hold material adjacent to that surface in place.

Figure 7:
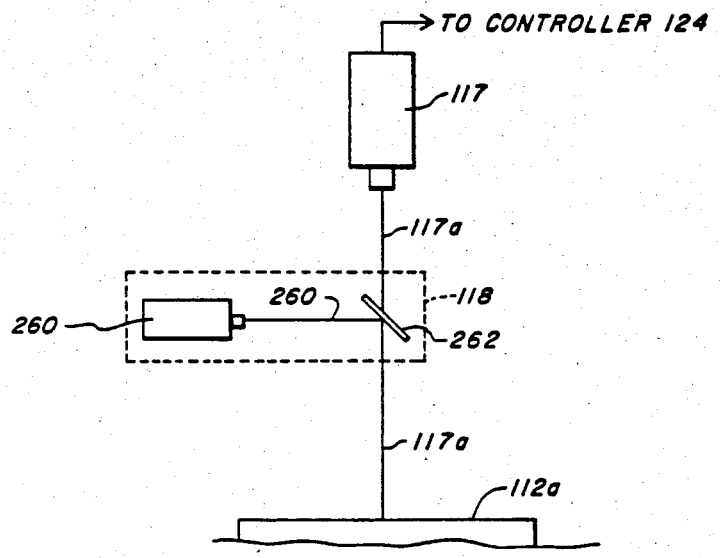
FIG. 7 illustrates the television camera and on-axis light source for the system of FIG. 1.
Figure 8:
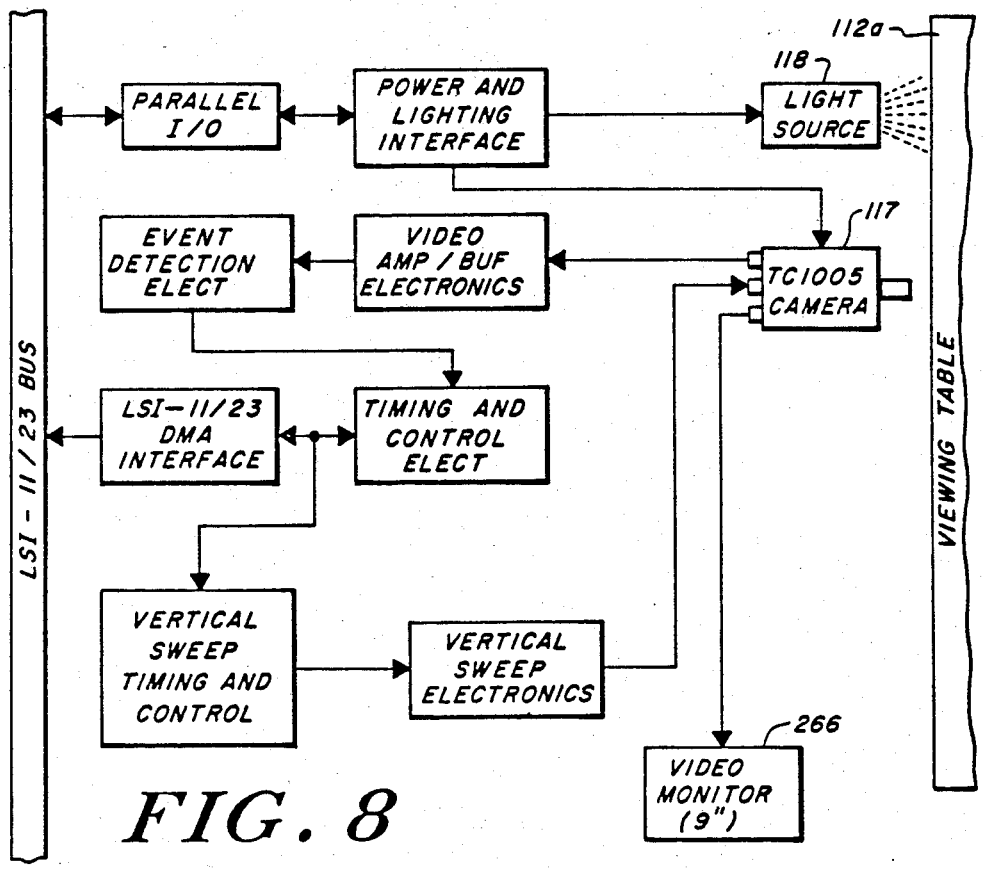
FIG. 8 shows in block diagram form an exemplary configuration for generating the position signals for use with the system in FIG. 1.

FIGS. 7 and 8 show the components of the optical sensor system of the present embodiment. FIG. 7 includes an optical sensor 117, and an illumination system 118. In the present embodiment, the sensor 117 is in the form of a conventional television camera, although other image signal generating devices may be used. The television camera 117 is supported so that its optical axis 117a is substantially normal to the surface 112a of the table 112. The illumination system 118 includes a light source 260 and an associated beam splitter 262. The beam splitter is positioned on the axis 117a between the camera 117 and surface 112a. That beam splitter 262, for example a mirror type beam splitter, is adapted to receive incident light from the light source 260 along path 260a, reflect a portion of that light along optical axis 117a to the surface 112a, and then to pass a portion of light reflected from surface 112a (or material positioned on that surface) back along the axis 117a to the television camera 117.

With this illumination arrangement, common axis illumination is achieved for the system for use with the retro-reflector configuration on surface 112a. The surface 112a may alternatively be formed by a translucent material which is backlit, or by a fluorescent surface (with appropriate filters for camera 117), although the retro-reflective common axis illumination approach is the preferred form for the present embodiment.

In operation, the camera 117 provides video signals representative of the image along the optical axis 117a of the surface 112 and any material thereon. The retro-reflective surface 112a in effect provide a high contrast background with respect to any material on surface 112.

At the controller 124, these video signals are processed to provide the position signals for use with the automatic seam joining and folding control portions of controller 124. FIG. 8 shows a block diagram of a portion of controller 124 which performs this function, in conjunction with the surface 112a, camera 117, and illumination source 118 and a video monitor 266. In the present embodiment, the controller 124 includes a type LSI-11/23 microcomputer, manufactured by Digital Equipment Corporation, Maynard, Mass. FIG. 8 also shows the interface between the camera and illumination system and the LSI-11/23 computer.

In operation, the functional block of controller 124 in FIG. 8 performs edge detection of the material against the background provided by surface 112a. The edge detection is performed by differentiating, or thresholding, the video signal generated by the camera 117 as the camera scanning beam sweeps across the image, marking the times within the sweep at which there is a predetermined change in video signal intensity. These various "edge" times for each scan line are provided to the computer upon request. By way of example, where the camera 117 is an RCA type TC1005/C49 camera, the image of the table may be scanned in two seconds, and the edge information provided to the microcomputer, together with some data checks and filtering on the raw data. Also within this time frame, the microcomputer computes the area of a material element in the field of view, the center of that area, and the angle the principal axis of that material with respect to the a reference axis on surface 112a. Appendices A and B show an exemplary technique for performing these data processing operations.

With this configuration, the television camera 117 provides an output signal from its video amplifier circuitry and uses a separately generated vertical sweep signal generated by a digital-to-analog converter controlled by the microcomputer in controller 124. With this arrangement, the D/A controlled vertical sweep provides capability to increase a number of scan lines and also to correct for non-linearity in a relatively inexpensive camera yoke. The timing and control portion of the controller 124 converts the event detectors put into a series of digital words that contain a time of the.event and the scan line number in which the event occurred. With this type system, a relatively high degree of edge resolution can be achieved without requiring the conventional type pixel-image processing approach, and associated substantial computation cost and time. In alternative embodiments of the invention, the overall seamed article assemblies system may be configured with conventional type optical sensing system, although at relatively high cost compared with the particularly cost effective system shown in FIGS. 7 and 8.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all change which come within the meaning and range of equivalency of the claims are therefore intended to be embraced therein.

APPENDIX A

Workpiece Recognition

A. Sensor Information

The camera scans the workpiece with respect to X-Y coordinates with the workpiece lying between X-coordinates O and $X_N$ with upper and lower limits $X_L$ and $X_H$, respectively. Scan lines run parallel to Y-axis, separated by $\Delta x$. Scan information consists of y-values for background-fabric transitions in the y-dimension, where $y_1$ is the left edge transition and $y_2$ is the right edge transition in a scan line. The distance between left edge and right edge transitions for the $i^{th}$ scan line, $\Delta y_i$, is equal to $y_{2i}-y_{1i}$. The differential area for the $i^{th}$ scan line, $dA_i$ equals $\Delta x_i \Delta y_i$, or $(y_{2i}-y_{1i})\,dx$, or $dydx$.

B. Computation $$\text{Area } A = \int\int dA$$

$$= \int_0^{X_N} \int_{y_1(x)}^{y_2(x)} dydx$$

$$= \int_0^{X_N} [y_2(x) - y_1(x)]dx$$

$$= \Delta x \sum_{X=0}^{X_N} [y_2(x) - y_1(x)]$$

$$= \Delta x \sum_{i=0}^{N} y_i$$

Centroid $$x_c = \frac{1}{A} \int\int x dA$$

-continued $$= \frac{1}{A} \int_0^{X_N} \int_{y_1(x)}^{y_2(x)} x dydx$$

$$= \frac{1}{A} \int_0^{X_N} x[y_2(x) - y_1(x)]dx$$

$$= \frac{\Delta x}{A} \sum_{X=0}^{X_N} x[y_2(x) - y_1(x)]$$

$$= \frac{\Delta x}{A} \sum_{i=0}^{N} x_i \Delta y_i$$

Centroid $$y_c = \frac{1}{A} \int\int y dA$$

$$= \frac{1}{A} \int_0^{X_N} \int_{y_1(x)}^{y_2(x)} y dydx$$

$$= \frac{1}{A} \int_0^{X_N} \left\{ \frac{y^2}{2} \Big|_{y_1(x)}^{y_2(x)} \right\} dx$$

$$= \frac{1}{A} \int_0^{X_N} \left[ \frac{y_2^2(x) - y_1^2(x)}{2} \right]^{dx}$$

$$= \frac{\Delta x}{2A} \sum_{X=0}^{X_N} [y_2^2(x) - y_1^2(x)]$$

$$= \frac{\Delta x}{2A} \sum_{i=0}^{N} (y_2^2 i - y_1^2 i)$$

Moment $$I_{xx} = \int\int y^2 dA$$

$$= \int_0^{X_N} \int_{y_1(x)}^{y_2(x)} y^2 dydx$$

$$= \int_0^{X_N} \left\{ \frac{y^3}{3} \Big|_{y_1(x)}^{y_2(x)} \right\} dx$$

$$= \int_0^{X_N} \left[ \frac{y_2^3(x) - y_1^3(x)}{3} \right]^{dx}$$

$$= \frac{\Delta x}{3} \sum_{X=0}^{X_N} [y_2^3(x) - y_1^3(x)]$$

$$= \frac{\Delta x}{3} \sum_{i=0}^{N} (y_2^3 i - y_1^3 i)$$

Moment $$I_{yy} = \int\int x^2 dA$$

$$= \int_0^{X_N} \int_{y_1(x)}^{y_2(x)} x^2 dydx$$

$$= \int_0^{X_N} x^2[y_2(x) - y_1(x)]dx$$

$$= \Delta x \sum_{X=0}^{X_N} x^2[y_2(x) - y_1(x)]$$

$$= \Delta x \sum_{i=0}^{N} x^2 i \, \Delta y_i$$

-continued

Moment $$I_{xy} = \int\int xydA$$

$$= \int_0^{X_N} \int_{y_1(x)}^{y_2(x)} xydydx$$

$$= \int^{X_N} x\left\{ \frac{y^2}{2} \Big|_{y_1(x)}^{y_2(x)} \right\} dx$$

$$= \int_0^{X_N} x\left[ \frac{y_2^2(x) - y_1^2(x)}{2} \right]^{dx}$$

$$= \frac{\Delta x}{2} \sum_{X=0}^{X_N} x[y_2^2(x) - y_1^2(x)]$$

$$= \frac{\Delta x}{2} \sum_{i=0}^{N} x_i(y_2^2 i - y_1^2 i)$$

C. Principal Axis with Respect to Centroid Coordinate Frame

The next step is to convert the moments from the measurement into centroid frame, which is parallel to the original frame, but offset by the coordinates of the computed centroid. The converted moments are:

$$I'_{xx} = I_{xx} - y_c^2 A$$
$$I'_{yy} = I_{yy} - x_c^2 A$$
$$I'_{xy} = I_{xy} - x_c y_c A$$

$$\theta' = \tfrac{1}{2} \tan^{-1}\left[ \frac{-2I'_{xy}}{I'_{xx} - I'_{yy}} \right]$$

where $\theta'$ corresponds to the angular offset of the workpiece centroid with respect to the principal axes.

D. Algorithm in BASIC

Below is shown all the BASIC language statements that are necessary to implement the "moment calculations". Only eight multiplications and nine additions or subtractions are required in the high-frequency loop. YL and YR represent the values for the left and right profile, respectively, of the workpiece for each scan line.

```
100 FOR X = 0 to XMAX STEP DX
110
200 READ YL, YR
210 DY = YR - YL
220 YRSQ = YR * YR
230 YLSQ = YL * YL
240 DYSQ = YRSQ - YLSQ
250 YRCUB = YRSQ * YR
260 YLCUB = YLSQ * YL
270
300 SUM1 = SUM1 + DY
310 SUM2 = SUM2 + X * DY
320 SUM3 = SUM3 + DYSQ
330 SUM4 = SUM4 + YRCUB - YLCUB
340 SUM5 = SUM5 + X * X * DY
350 SUM6 = SUM6 + X * DYSQ
360
370 NEXT X
380
390
400 A = DX * SUM1
410 XC = DX * SUM2/A
```

-continued

```
420 YC = DX * SUM3/(2 * A)
430
440 IXX = DX * SUM4/3
450 IYY = DX * SUM5
460 IXY = DX * SUM6/2
470
480 IXX = IXX - YC * YC * A
490 IYY = IYY - XC * XC * A
500 IXY = IXY - XC * YC * A
510 Theta = 0.5 * ATAN((-2*IXY)/(IXX - IYY))
```

Appendix B

Sleeve Data Base

The following information forms the "data base" for the machine, before each sewing or folding operation, for each sleeve size and style. (Only the right or left sleeve need be defined):

1. Nominal visual Area of workpiece (A)
2. Reasonable Tolerance for computed area ($\pm\epsilon A$)
3. Centroid correction as function of area variation ( $\partial x_c/\partial\epsilon A$, $\partial y_c/\partial\epsilon A$)
4. With respect to a "sleeve" coordinate system (i.e., origin at centroid, x-axis along longitudinal principal axis):

A. Checkpoints (e.g. to identify left- vs. right-hand piece, verify measurement expected coordinates of intercept of centroid axes ($\pm\bar{x}_c,\bar{y}_c$) and workpiece reasonable tolerance for any detected edge ($\pm\epsilon x$, $\pm\epsilon y$)

B. Seam "trajectory"

coordinates of first stitch (e.g. off leading edge)

number of individual stitches individual stitch segments $\Delta x$, $\Delta y$ from previous stitch maximum sewing machine speed over segment easing rate over segment (standard material)

gap stretching rate over segment (standard material)

feeddogs up-down flag presser foot up-down flag

C. Folding "trajectory"

The transformation from "plotting" to "centroid" coordinates involves a ($x_c$,$y_c$) offset, followed by a rotation by angle O:

$$(\bar{x})_c = [(\bar{x})_p - (x_c y_c)] \begin{bmatrix} \cos\theta & -\sin\theta \\ \sin\theta & \cos\theta \end{bmatrix}$$

The transformation relationship for the stitch segments ($s_i - s_j$) is slightly different:

$$(\overline{\Delta s})_c = (\overline{\Delta s})_p \begin{bmatrix} \cos\theta & -\sin\theta \\ \sin\theta & \cos\theta \end{bmatrix}$$

To provide measurement and a First Reasonableness Test where both the workpiece and table coordinate frame visible within the camera field-of-view, the scan algorithm is as follows:

1. For each scan line$_i$

Read $y_1, y_2, \ldots, y_n$ (n varies with shape)

If $(y_2 - y_1) > \epsilon$ or $(y_n - Y_{n-1}) > \epsilon$ or if $(y_3 - y_2) < \epsilon$ or $(y_{n-1} - y_{n-2}) < \epsilon$ then increment a counter and use previous $\Delta y_i$ For j=3 to n−2, step 2

$\Delta y_i = \Delta y_i + (y_{j+1} - y_j)$

Accumulate y's for Area computation.

2. Compute Area as $$\Delta x \sum_{i=1}^{N} \Delta y_i$$

3. Compare $A_{meas}$ with $A_{DB} + \epsilon A_{DB}$

If not in interval, repeat measurement and increment counter. If counter is beyond a threshold, alert operator.

For each scan line, partial sums can be accumulated for the centroid and principal angle:

For $i = 1$ to $N$

Accumulate $\underbrace{(i\Delta x)}_{x_i}\Delta y_i$ (For $x_c$)

Accumulate $\underbrace{(i\Delta x)^2}_{x_i^2}\Delta y_i$ (For $I_{yy}$)

For $j = 3$ to $n - 2$, step 2

Accumulate $(y_{j+1}^2 - y_j^2)$ (For $y_c$)

Accumulate $(y_{j+1}^3 - y_j^3)$ (For $I_{xx}$)

Accumulate $(i\Delta x)(y_{j+1}^2 - y_j^2)$ (For $I_{xy}$)

Using those partial sums, the centroid and principle angle can easily be calculated using the algorithm described in Appendix A, that is:

$$xc = \frac{\Delta x}{A} \sum_{i=1}^{N} x_{y_i}, \; y_c = \frac{\Delta x}{2A} \sum_{i=1}^{N} \sum_{j=3}^{n-2} (y_{j+i}^2 - y_j^2)$$

To provide a Second Reasonableness Test and Right- vs. Left-Piece identification, even if the detected area, centroid, and principal angle seem reasonable, there may still be some ambiguity whether a "righthand" or "lefthand" piece was loaded and scanned.

Unless the piece is exactly symmetrical about its two principal axes, the four predicted x, y intercepts with the piece edges can be checked to (1) ascertain whether a right- or left-handed piece was loaded and (2) perform a final reasonableness test.

In the present form, only "mirror" loading about the piece longitudinal axis is allowed; i.e., only the $y_+$ and $y_-$ intercepts str used to determine whether a right- or left-handed piece was loaded. If the $x_+$, $x_-$ are not confirmed, the piece is rejected (or centroid corrected). Thus, the piece can not be loaded backwards.

Also, if the predicted $x_c$, $y_c$ intercepts are "close" and consistent with a slightly larger or smaller area, the centroid and principal angle is adjusted slightly to allow for miscut pieces or unpredictable manual folding variations.

An exemplary algorithm is as follows:

1. Determine if predictable intercepts $y_+$, $y_-$ can be confirmed with actual camera data.
   a. convert the x-components (in table coordinates) of $y_+$ and $y_-$ to a particular scan line number (i.e., $i_+$, $i_-$).
   b. convert the y-components (in table coordinates) of $y_+$ and $y_-$ to a particular camera y-displacement (i.e., $\Delta y_+$, $\Delta y_-$).
   c. Look at the raw camera data (or repeat the scan) for a $y_+$ value (i.e., tablepiece transition) along scan line $i_+$ and a $y_-$value along scan line $i_-$. Use a reasonable y for success criterion.
   d. If concurrence results, proceed to Step 2. If not, swap $y_+$ and $y_-$ and repeat Steps 1*a*–1*c* (look for concurrence for mirror-image around x axis).
   e. If concurrence results from swapping the y's, then change the sign of the y-component for all trajectory points (i.e., start-end of seam and y for each stitch).
   f. If no concurrence again, then stop and inform operator.
2. Repeat Steps 1*a*–1*c* for $x_+$ and $x_-$. If concurrence, preceed to Step 3; if not, stop and inform operator.
3. Correct the trajectory for the small differences between predicted and measured intercept values, using one of the following rules:

(a)

$$x_c = x_c + \partial x_c / \partial \epsilon A$$

$$y_c = y_c + \partial y_c / \partial \epsilon A$$

$$\theta = \theta + \partial \theta / \partial \epsilon A$$

where $\partial x_c / \partial \epsilon A$, etc. are empirical values from the data base.

Then use the new $x_c$, $y_c$, and $\theta$ values to retransform the sewing/folding trajectory from centroid to table coordinates.

(b) Use the $(x_{+(actual)} - x_{+(predict)})$ value to correct all positive x-coordinates of trajectories (i.e., beginning and ending of seams and folds, but not $\Delta x$, $\Delta y$ of stitches). This, if the detected $x_+$ point falls further from the centroid than the predicted $x_+$ point, "expand" the beginning or end of the trajectory further away from the centroid in the +x direction.

Repeat similarly for the −x, +y, and −y directions.

The last step prior to sewing is to transform the stitch trajectory from table into sewing module (control) coordinates.

It's preferred to define the x sewing axis as originating from the sewing gap so that the velocity of the workpiece may change as it crosses the gap, due to different main motor and stretching motor rates. In order to simplify sewing "navigation" equations, $(x_{TS}, -y_{TS})$ is subtracted from every non-stitch segment (i.e., non x, y) coordinate of the trajectory. This converts the centroid and seam start-end points into sewing coordinates.

The sewing translator is slewed to the y-coordinate of the start of the seam.

Simultaneously, the belts (and workpiece) are moved, continually keeping track of the x-coordinate of the centroid (or the first stitch) in sewing coordinates as it decreases toward zero (approaches the needle).

When $(x_c)_{sewing}$ reaches the value of $-(s_{1(x)} - x_c)_{table}$ or $(s_{1(x)sewing})$ reaches zero, (i.e., the start of the first stitch passes under the needle), and/or the fabric is detected under the needle, then sewing commences by issuing $\Delta x$, $\Delta y$ commands to the belts and translator from the sewing trajectory.

The x-position of the centroid (or first stitch) is continually be updated, so that the piece can be brought back to the original position on the loading table (or taken to the proper position on the folding table) after sewing is completed.

When the centroid (or first stitch) passes across the sewing gap, its speed is goverened by the main motor and the stretching motor.

We claim:

1. A limp material handling system, comprising:

a limp material manipulating system for selectively manipulating one or more layers of limp material, comprising:

A. a support assembly adapted to support said material on a reference surface,

B. a fold assembly including selectively operable:

i. means for gripping a curvilinear region of at least an uppermost layer of said material, ii. means for:

(a) controlling the curvature of said gripped curvilinear region whereby said gripped curvilinear region has a selected contour, (b) selectively translating and selectively rotating said gripped curvilinear region to a selected location overlying an associated curvilinear region of said reference surface, and iii. means for releasing said gripped curvilinear region to said associated curvilinear region of said reference surface or the next uppermost layer of said material overlying said associated curvilinear region of said reference surface, and C. a controller including means for selectively controlling said fold assembly.

2. A limp material handling system according to claim 1, further comprising:

a seam joining means selectively positionable along a first reference axis for selectively joining adjacent regions of one or more layers of said limp material elements, a multiple parallel endless belt assembly including:

A. material transport and alignment means including means for selectively transporting said limp material elements through points on said first reference axis, and for selectively orienting said limp material elements with respect to said first reference axis, B. tension means for selectively controlling the tension of said limp material elements in regions of said material adjacent to and including said first reference axis, said controller comprising an assembly controller including means for selectively controlling said limp material elements whereby said elements are selectively positioned, folded and joined to form assembled seamed articles.

3. A limp material handling system according to claims 1 or 2 wherein said support assembly includes a substantially planar upper surface, said upper surface including an array of holes passing therethrough, and including means for coupling a vacuum to said array of holes 4. A limp material handling system according to claims 1 or 2 wherein said gripping means and said curvature modifying means include at least one elongated carrier assembly having a curvilinear central axis extending along its elongated length, including a plurality of gripping elements coupled to said carrier and fixedly positioned with respect to said central axis, said gripping elements being adapted for selectively gripping the regions of said material underlying said gripping elements and wherein said curvature modifying means further includes selectively operable curvature control means for controlling the curvature of said central axis.

5. A limp material handling system according to claim 4 wherein said carrier assembly includes an elongated housing and an elongated flexible member coaxial with said central axis and having one end affixed to said housing and its other end slidingly coupled to said housing, said flexible member including means for supporting said gripping elements, and wherein said carrier assembly further includes selectively operable means for applying forces to said flexible member in directions transverse to said central axis at two or more points between the ends of said flexible member whereby the curvature of said central axis is controlled.

6. A limp material handling system according to claims 1 or 2 wherein said gripping means and said curvature modifying means include a hinged, linearly segmented assembly, each segment being elongated and including a plurality of gripping elements positioned along the principle axis of said segment, said gripping elements being adapted for selectively gripping the regions of said material underlying said elements, and wherein said curvature modifying means further includes selectively operable means for orienting said segments to establish a predetermined segment-to-segment angular orientation.

7. A limp material handling system according to claim 6 wherein at least one of said segments includes a means for selectively offsetting the position of said gripping elements of said segment in the direction perpendicular to the direction of elongation of said segment and perpendicular to the normal to said reference surface.

8. A limp material handling system according to claim 4 wherein said gripping elements each comprise means for selectively coupling a vacuum to said material region underlying said element.

9. A limp material handling system according to claim 4 wherein said gripping elements each comprise a grabber means for selectively attaching to said material region underlying said grabber means.

10. A limp material system according to claim 9 wherein said grabber means comprises an elongated member extending along an axis perpendicular to the underlying portion of said reference surface and having a barb which extends transversely from the tip of said elongated member closest to the underlying portion of said surface, and further comprises means for selectively reciprocating said elongated member in the direction perpendicular to said reference surface.

11. A limp material handling system according to claim 6 wherein said gripping elements each comprise means for selectively coupling a vacuum to said material region underlying said element.

12. A limp material handling system according to claim 6 wherein said gripping elements each comprise a grabber means for selectively attaching to said material region underlying said grabber means.

13. A limp material handling system according to claim 12 wherein said grabber means comprises an elongated member extending along an axis perpendicular to the underlying portion of said reference surface and having a barb which extends transversely from the tip of said elongated member closest to the underlying portion of said reference surface, and further comprises means for selectively reciprocating said elongated member in the direction perpendicular to said reference surface.

14. A limp material handling system according to claims 1 or 2 further comprising an optical sensing system including means for generating position signals representative of the shape and orientation of said material on said reference surface, and including means for transferring said signals to said controller, wherein said controller is responsive to said position signals to control said fold assembly.

15. A limp material handling system according to claim 14 wherein said optical sensing system includes:

A. an optical sensor means for generating video signals and an associated means for supporting said sensor directing the optical axis of said sensor toward said reference surface from above said surface, said video signals being representative of an image along said optical axis on said reference surface and said material thereon, B. a plurality of retro-reflective elements on said reference surface, said retro-reflective elements being adapted to reflect light incident thereon along said optical axis back along said optical axis dispersed substantially about said optical axis, and C. a common axis illumination system including a directional light source and associated beam splitter, said beam splitter being positioned along said optical axis between said camera means and said reference surface, whereby at least a portion of light from said light source is directed along said optical axis toward said reference surface, and at least a portion of said reflected light passed through said beam splitter to said camera means, wherein said controller is responsive to said video signals to generate said position signals.

16. A limp material handling system according to claim 14 wherein said support assembly includes a substantially planar upper surface, said upper surface including an array of holes passing therethrough, and including means for coupling a vacuum to said array of holes.

17. A limp material handling system according to claim 16 wherein said optical sensing system includes:

A. an optical sensor means for generating video signals and an associated means for supporting said sensor and directing the optical axis of said sensor toward said reference surface from above said surface, said video signals being representative of an image along said optical axis on said reference surface and said material thereon, B. a plurality of retro-reflective elements on said reference surface, said retro-reflective elements being adapted to reflect light incident thereon along said optical axis back along said optical axis dispersed substantially about said optical axis, and C. a common axis illumination system including a directional light source and associated beam splitter, said beam splitter being positioned along said optical axis between said camera means and said reference surface, whereby at least a portion of light from said light source is directed along said optical axis toward said reference surface, and at least a portion of said reflected light passed through said beam splitter to said camera means, wherein said controller is responsive to said video signals to generate said position signals.

18. A limp material handling system according to claim 2 wherein said belt assembly includes a first set of parallel endless belts overlying a limp material support surface and a second set of parallel endless belts overlying said limp material support surface, said first is being opposite said second set, wherein at least some belts of said first and second sets are two state belts and are controllable to overlie said first reference axis in a first state and to be entirely on one side of said first reference axis in a second state, and wherein said assembly controller is selectively operable to control said two state belts whereby said two state belts are in said second state when said seam joining means is adjacent thereto and in said first state otherwise.

19. A limp material handling system according to claim 18 wherein each of said two state belts is supported on at least one fixed roller assembly and two controllably positioned roller assemblies, said roller assemblies being toothed, and wherein the inner surface of said belts is toothed.

20. A limp material handling system according to claim 18 wherein each of said two state belts is supported on one fixed roller assembly and two controllably positioned roller assemblies.

21. A limp material handing system according to claims 1 or 2 wherein said fold assembly further includes selectively operable means for selectively lifting and selectively lowering said gripped curvilinear regions of said material.

* * * * *